US010486775B2

(12) United States Patent
Nøstvold

(10) Patent No.: US 10,486,775 B2
(45) Date of Patent: Nov. 26, 2019

(54) GANGWAY FOR TRANSFERRING PERSONNEL AND EQUIPMENT FROM A FIRST DEVICE TO A SECOND DEVICE

(71) Applicant: KYSTVÅGEN SLIP & MEK AS, Frei (NO)

(72) Inventor: Bjørn Nøstvold, Røyneberg (NO)

(73) Assignee: KYSTVAGEN SLIP & MEK AS, Frei (NO)

( * ) Notice: Subject to any disclaimer, the term of this patent is extended or adjusted under 35 U.S.C. 154(b) by 0 days.

(21) Appl. No.: 16/196,645

(22) Filed: Nov. 20, 2018

(65) Prior Publication Data

US 2019/0084654 A1 Mar. 21, 2019

Related U.S. Application Data

(63) Continuation of application No. PCT/NO2017/050145, filed on Jun. 6, 2017.

(30) Foreign Application Priority Data

Jun. 15, 2016 (NO) ..... 20161009

(51) Int. Cl.
*B63B 27/00* (2006.01)
*B63B 27/14* (2006.01)
*B63B 27/30* (2006.01)

(52) U.S. Cl.
CPC ..... *B63B 27/14* (2013.01); *B63B 27/143* (2013.01); *B63B 27/30* (2013.01); *B63B 2027/141* (2013.01)

(58) Field of Classification Search
CPC ..... B63B 27/14; B63B 27/143; B63B 27/30; B63B 2027/141

(Continued)

(56) References Cited

U.S. PATENT DOCUMENTS 4,473,916 A * 10/1984 Connold ..... B63B 27/14 14/42
4,513,465 A * 4/1985 Schambeck ..... E01D 11/04 14/18

(Continued)

FOREIGN PATENT DOCUMENTS

| | | |
|---|---|---|
| GB | 2034649 A | 6/1980 |
| JP | H01105611 U | 7/1989 |
| WO | 2014077694 A1 | 5/2014 |

OTHER PUBLICATIONS

International Search Report issued by the Nordic Patent Institute acting as the International Searching Authority in relation to International Application No. PCT/NO2017/050145 dated Sep. 1, 2017 (3 pages).

(Continued)

*Primary Examiner* — Raymond W Addie
(74) *Attorney, Agent, or Firm* — Robert P. Michal, Esq.; Carter, DeLuca & Farrell LLP

(57) ABSTRACT

A gangway for transferring personnel and equipment from a first device to a second device which are able to move relative to each other. The gangway includes gangway sections which are telescopically movable relative to each other, a first end section of the gangway being mounted on the first device, a second end section of the gangway being movable and mountable to the second device. The first end section of the gangway, in a region thereof, is mounted in a support frame suspended within a gyro arrangement maintaining the gangway in a substantially horizontal plane. The gyro arrangement is located on a turning plate foundation mounted on the first device and the second end section of the gangway is provided with connector means for interconnection with the second device.

6 Claims, 8 Drawing Sheets

(58) Field of Classification Search
USPC ..... 14/18–23, 71.3, 77.1, 78; 114/361
See application file for complete search history.

(56) References Cited

U.S. PATENT DOCUMENTS

| | | | | |
|---|---|---|---|---|
| 7,493,868 | B1 | 2/2009 | Amal et al. | |
| 7,743,444 | B2 * | 6/2010 | Murakoshi | E01D 11/00 14/18 |
| 8,572,787 | B2 * | 11/2013 | Toguchi | E01D 11/02 14/18 |
| 8,925,130 | B2 * | 1/2015 | Bedford | B63B 21/00 114/362 |
| 2008/0229524 | A1 * | 9/2008 | Watchorn | B63B 27/143 14/69.5 |
| 2010/0199444 | A1 | 8/2010 | Fleischer et al. | |
| 2015/0121635 | A1 * | 5/2015 | Prins | B63B 27/14 14/71.1 |
| 2018/0141652 | A1 * | 5/2018 | Deslypper | B64C 3/54 |

OTHER PUBLICATIONS

Written Opinion of the International Searching Authority issued by the Nordic Patent Institute acting as the International Searching Authority in relation to International Application No. PCT/NO2017/050145 dated Sep. 1, 2017 (3 pages).
Norwegian Search Report issued by the Norwegian Patent Office in relation to Norwegian Application No. 20161009 dated Jan. 12, 2017 (2 pages).

* cited by examiner

GANGWAY FOR TRANSFERRING PERSONNEL AND EQUIPMENT FROM A FIRST DEVICE TO A SECOND DEVICE

CROSS-REFERENCE TO RELATED APPLICATIONS

This application is a continuation of International Application No. PCT/NO2017/050145 filed Jun. 6, 2017, which claims priority to Norwegian Patent Application No. 20161009, filed Jun. 15, 2016, the disclosure of each of these applications is expressly incorporated herein by reference in their entirety.

The invention relates to a mobile gangway for allowing personnel and equipment to be safely transferred from one device to another, including a gangway comprised of sections which are telescopically movable relative to each other, the gangway being suspended in a gyro arrangement mounted on a turning plate, which also serves as a base for the gangway.

The challenge faced when personnel and equipment are to be transferred from one device to another at sea is that wave motions induce different movement patterns to the two devices, which may cause dangerous situations in cases where the transfer is accomplished in that personnel jumps from the one device to the other by positioning the devices close to each other and letting the personnel pick a favorable moment to jump over to the other device.

The prior art related to the transfer of personnel between vessels or from a vessel to an installation includes several types of devices.

For the transfer of personnel from hotel platforms to oil installations, for example, a gangway is commonly used which is maneuvered by a crane arrangement located above the gangway, or which is movable by means of e.g. hydraulic actuators, and may be stabilized or locked to a specially adapted connection point on the receiving structure.

The prior art also involves devices installed on vessels, which devices are provided with clamps for gripping vertical buffer tubes being part of the structure to which transfer of personnel is desired. When the vessel has been stabilized against said structure, a gangway or personnel platform is established to the structure in order to transfer the personnel.

U.S. Pat. Nos. 6,347,424 and 4,169,296 disclose gang bridges that are maneuvered over to the receiving device by means of a crane arrangement. The drawbacks of both these solutions are that the receiving device needs to be adapted to the gang bridge by way of an arrangement for locking the gang bridge, and that these bridge structures are large and hence not suitable for smaller vessels.

US 20110038691 A1 discloses a robotic arm having a personnel/equipment ramp mounted thereon, which robotic arm is to minimize the relative movement between the personnel/equipment ramp and the structure to which transfer of personnel/equipment is desired. In addition, the vessel has rollers mounted thereon, which rollers are extended by the vessel towards vertical buffer tubes as a means for stabilizing the vessel. The drawback of this solution is that the need for the vessel and a structure to which transfer of personnel is desired to be physically in contact with each other will strongly limit the maximum wave heights with which the equipment can be used.

Another drawback is that buffer tubes normally are not provided on a wind turbine, for example, around its entire circumference. Consequently, this solution is best suited for waves and wind from certain directions.

EP 2,487,102 A1 discloses an apparatus intended particularly for use in connection with the transfer of personnel to offshore wind turbines. The apparatus is installed on a vessel and includes a set of locking clamps that locks around the vertical buffer tubes commonly found on offshore wind turbines. Then, a gangway may be guided towards a desired transfer point on the wind turbine. The drawback of this solution too is a relatively limited maximum allowable wave height, with testing of the equipment in waves up to 1.9 m Hs being reported.

A solution using hydraulic actuators in order to keep the gangway stable and compensate for the vessel movements is systems offered by Ampelmann Operations BV (www.ampelmann.nl). The drawbacks of this system are that it is a complex system which is costly to produce and expensive in use.

The object of the invention is to remedy or reduce at least one of the drawbacks of the prior art, or at least provide a useful alternative to the prior art.

An object is to provide a device that is more easily adaptable in size in order to enable its use on the vessel best suited for a task to be accomplished thereby.

An object is to provide a gangway which does not require a specially adapted receiving structure to which to secure the gangway.

The objects of the present invention are achieved by a gangway for transferring personnel and equipment from a first device to a second device which are able to move relative to each other, the gangway being comprised of gangway sections which are telescopically movable relative to each other, with a first end section of the gangway being mounted on the first device, and a second end section of the gangway being movable and mountable to the second device, characterized in that the first end section of the gangway, in a region thereof, is mounted in a support frame suspended within a gimbal suspension maintaining the gangway in a substantially horizontal plane, the gimbal suspension being located on a turning plate foundation mounted on said first device and the second end section of the gangway being provided with connector means for interconnection with said second device, the gimbal mounting being comprised of a circular structure having two external rocker shafts mounted thereon which are supported in respective bearing pedestals arranged on struts mounted on the turning plate foundation, and the support frame being provided externally with a number of roller arrangements retained and freely movable internally in the circular structure.

Preferred embodiments of the gangway are set forth in more detail in claims 2 through 6.

A gangway for transferring personnel and equipment between two points which are not stationary relative to each other is provided, including a mobile telescopic gangway mounted by way of rollers or other support means into a gyro arrangement, called gimbal (cardanic) suspension, comprised of a circular structure having rocker shafts mounted thereon which are supported on struts mounted on a moving turning plate. The base of the turning plate also serves as a foundation for fixing the gangway. The centre of gravity of the gangway is located below the centre axis of the circular structure and, to a great extent, the gangway will maintain a horizontal position even if the vessel on which the device is installed undergoes roll and pitch movements. In order to be able to guide the gangway towards the point to which transfer of personnel is desired, and back to the parked position on the vessel, the turning plate of the gangway is provided with a preferably hydraulic motor, additionally to that the circular structure, preferably by means of hydraulic cylinders, are able change its angular position on the gangway. As the main part of the gangway is located on one side of the centre axis of the circular structure, it may be provided with a balance weight in order to equilibrate and balance the gangway. When the telescopic section is moved, preferably by means of hydraulic drive, an arrangement may be provided that simultaneously moves a balance weight in order to maintain balance regardless of the position assumed by the telescopic section.

Preferably, at the end of the telescopic section there are provided suction cups intended to hold the gangway stably against the device to which transfer of personnel is desired. The suction cups are supplied with vacuum by means of a vacuum generator, which may be integral to the gangway or be a separate unit. Suction cups are used because of the strong suction force they are able to produce. With such an arrangement the suction force may reach several tons. When suction cups are used as a means of stabilization against the receiving structure no specially adapted arrangement is required between the gangway and the receiving structure in order to maintain the gangway stable. The only requirement is a relatively even surface. The surface may be plane, as is the case for the hull of a ship, or curved as found on many offshore structures, as the suction cup configuration can be adapted to the shape that is most practical in view of the receiving structure. Another advantage of suction cups is that the attachment force of suction cups, as opposed to other mechanical fastening means, is adaptable by increasing or reducing the negative pressure so that the suction cups lose their grip before the gangway is structurally damaged should the distance between the vessel and the receiving structure come to exceed the reach of the gangway. The use of suction cups allows more freedom in connecting the gangway to a wind turbine, for example, at the side of the wind turbine that is most favorable with respect to wind and wave directions. Existing wind turbines only need to be retrofitted with an inexpensive and simple solution such as an even surface at the lower edge of and around the entire access deck of the wind turbine.

At the end of the telescopic section there may also be provided other attachment means in accordance with the prior art. Maneuvering of the gangway is carried out by an operator from a control panel which may be located on the gangway itself or be located at a distance from the gangway. When the gangway has been established to the receiving structure by way of the suction cups, which may advantageously have an indication that vacuum has been achieved associated therewith, the control handles are put in their centre position and a hydraulic arrangement will effect disengagement of the hydraulic actuators and motors. The relative movements between the device on which the gangway is installed and the device to which transfer of personnel is desired are now accommodated by the telescopic section of the gangway, the gimbal suspension as well as the turning plate. In order to further stabilize the gangway during the time before it is connected to the receiving structure the gangway may include a gyroscope.

Such a solution is also well suited for use with pilot boats, for example, in which case personnel may be transferred even while the vessels are moving. Today, the transfer of personnel to and from pilot boats is commonly accomplished by way of rope ladders, or in that the personnel picks the best moment during the wave motions to jump between the vessels, which poses a great risk of injury to the personnel in the event of misjudgment. The gangway and the telescopic gangway section will be provided with a railing configured as a telescopic railing.

In the following, an exemplary preferred embodiment will be described with reference to the accompanying drawings, in which.

Figure 8:
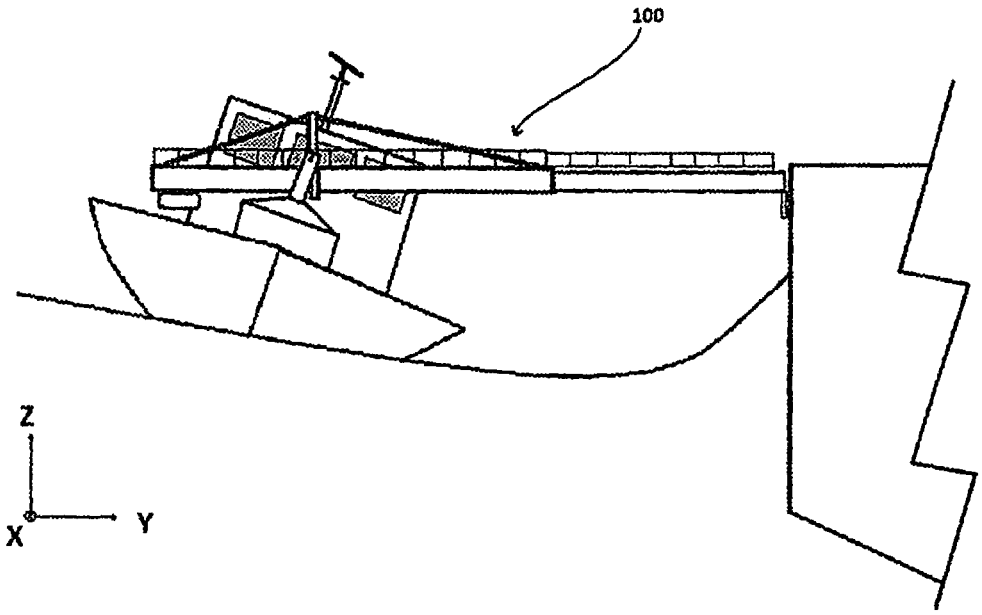
FIGS. 8 and 9 show a gangway installed on a smaller vessel, with the gangway having been connected to a larger vessel.
Figure 9:
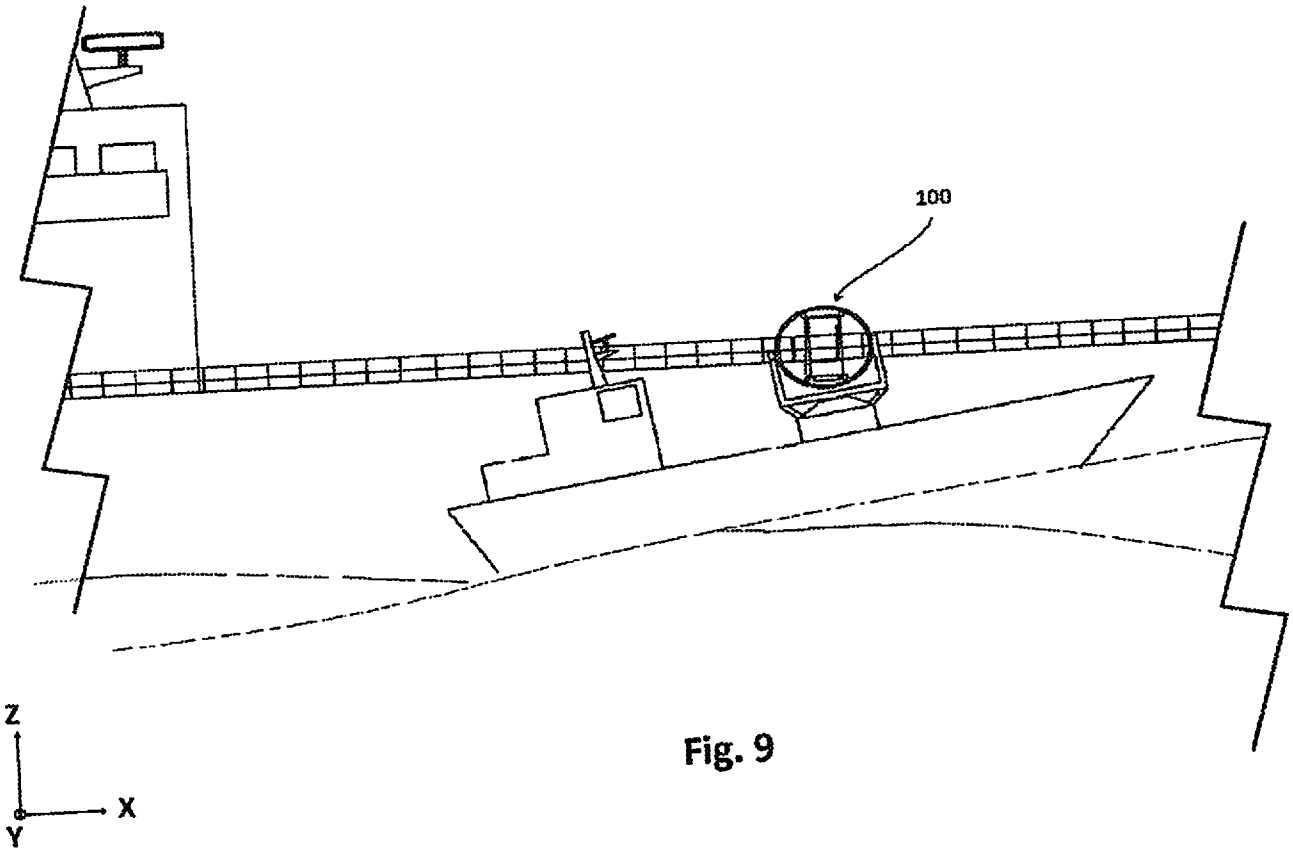

Similar elements have been given the same reference numbers in the different drawings. Directional indications X and Y, as shown in FIGS. 8 and 9, denote directions in the horizontal plane, and Z denotes directions in the vertical plane.

Figure 1:
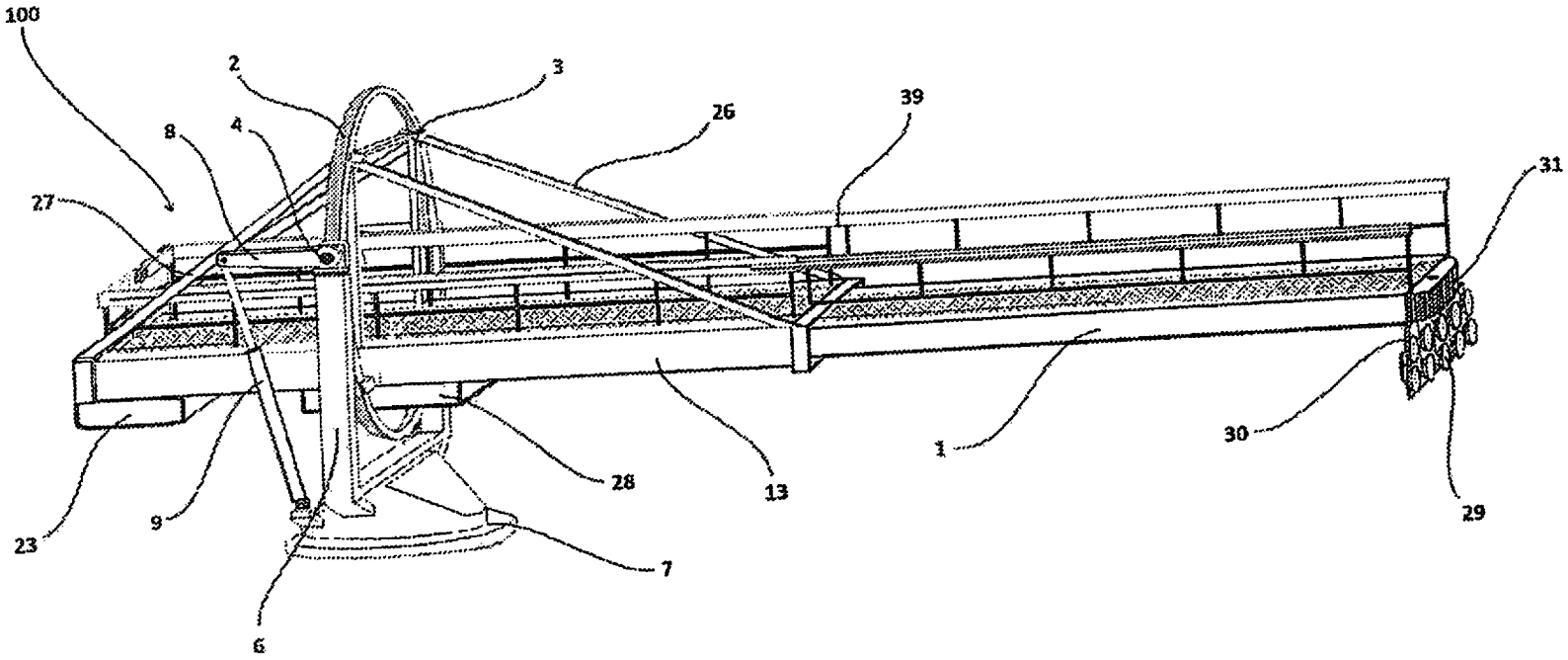
FIG. 1 is a perspective view showing a preferred embodiment of the gangway.
Figure 2:
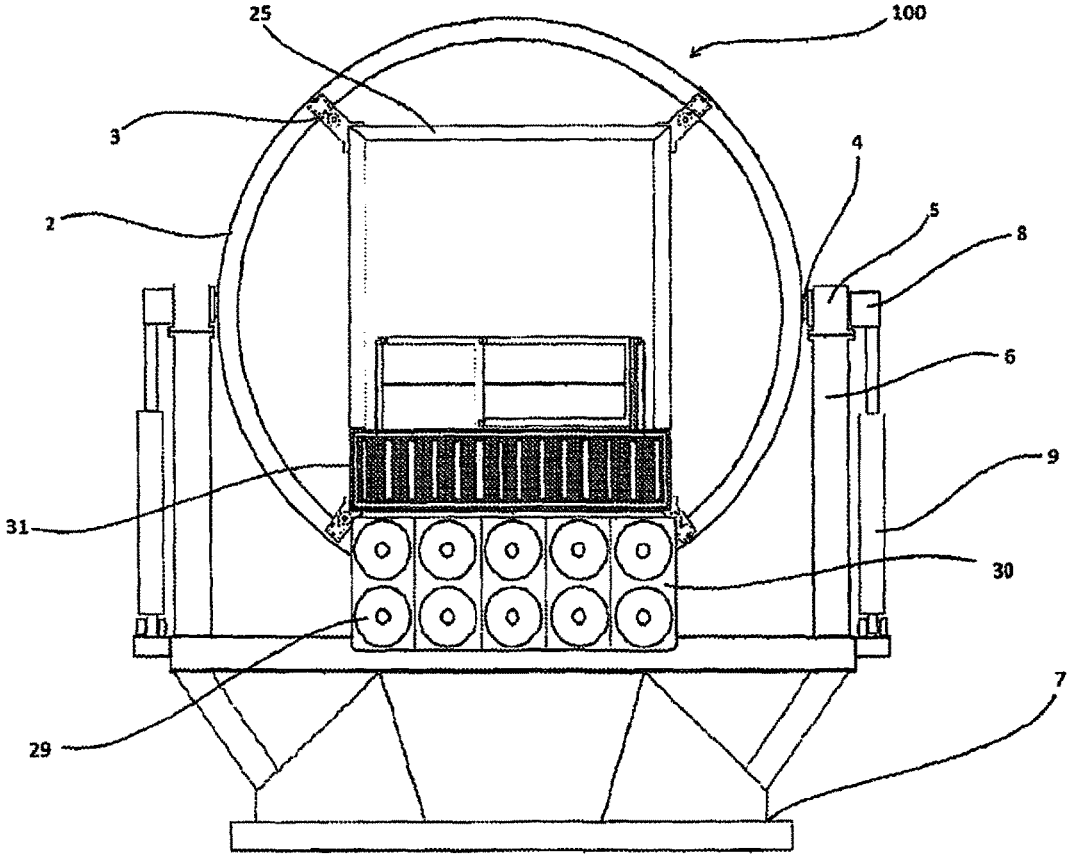
FIG. 2 is a front view showing the gangway.
Figure 3:
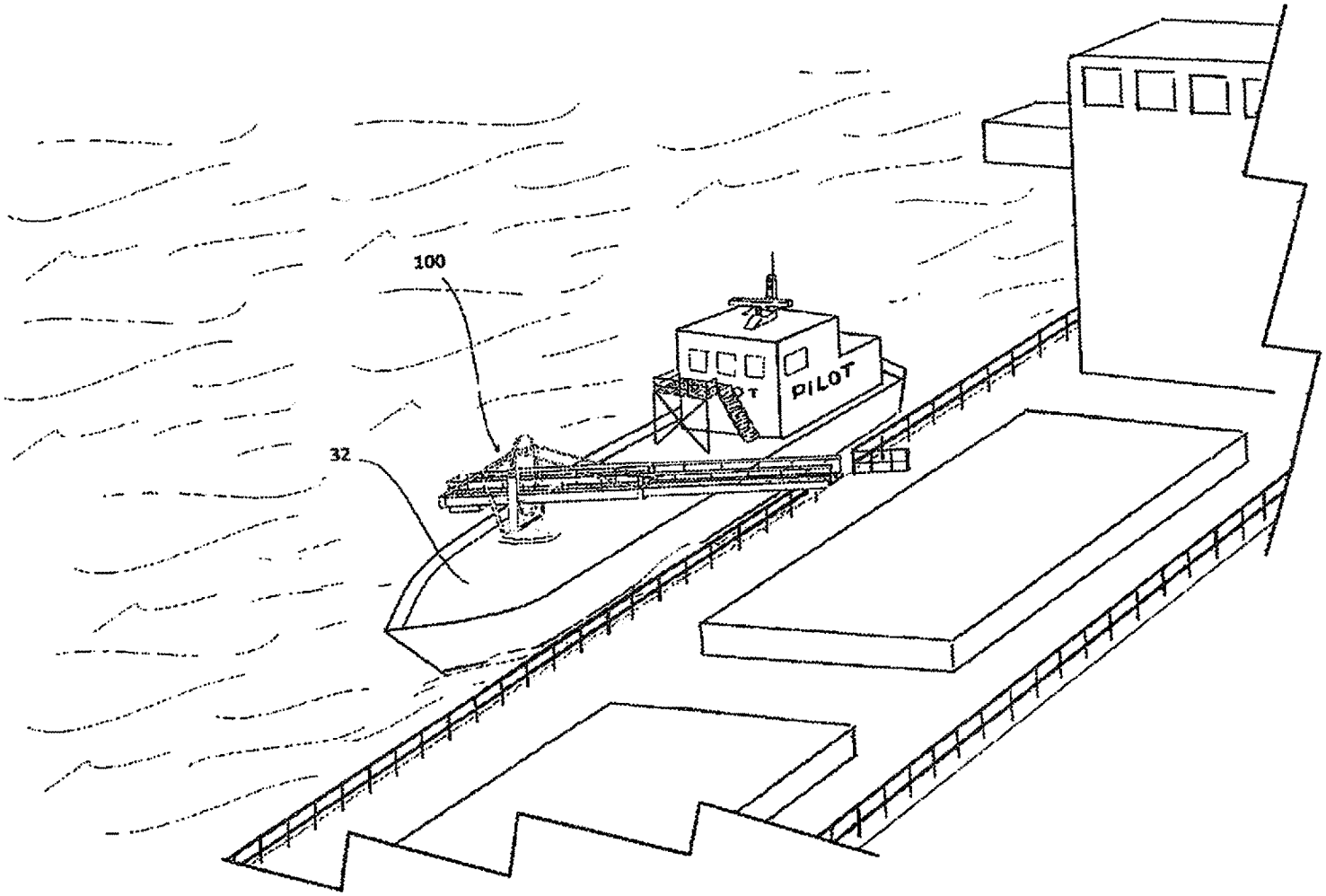
FIG. 3 shows a smaller version of the gangway installed on a smaller vessel, with the gangway having been established to a larger vessel.
Figure 4:
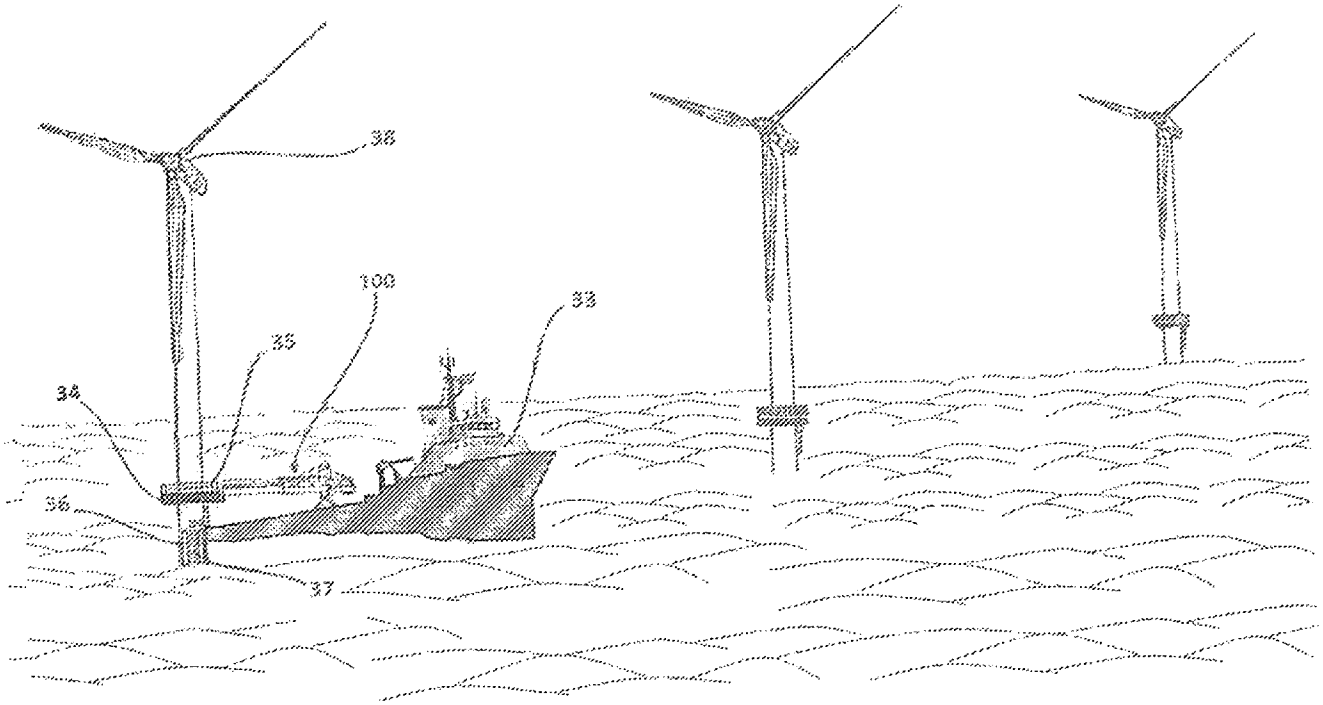
FIG. 4 shows a larger version of the gangway installed on a larger vessel, with the gangway having been established to a wind generator.
Figure 5:
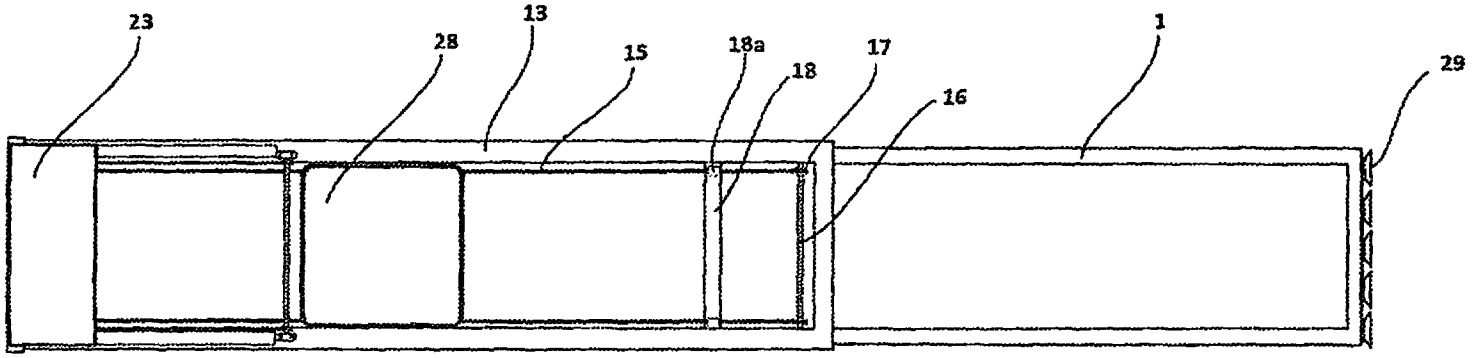
FIG. 5 is a bottom view showing the telescopic section of the gangway with the telescopic section in a maximum extended position and in which a driving gear for the telescopic section, balance weight, and gyroscope/gimbal suspension are indicated.
Figure 6:
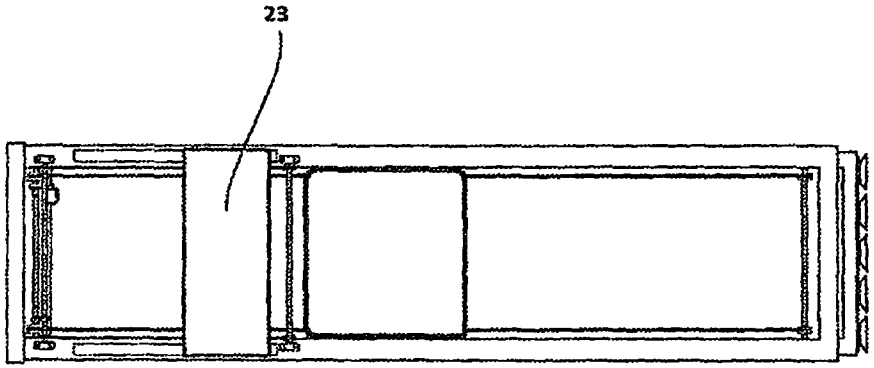
FIG. 6 is a bottom view showing the telescopic section of the gangway with the telescopic section in a minimum extended position and in which the driving gear of the telescopic section, balance weight, and gimbal suspension are indicated.
Figure 7:
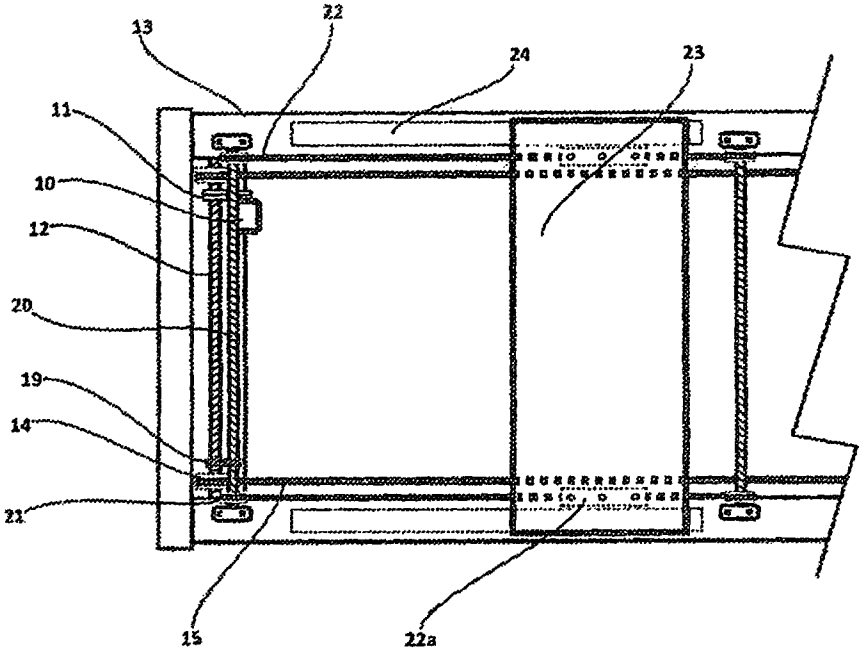
FIG. 7 is a sectional bottom view of the gangway showing the driving gear of the telescopic section and balance weight.

In the drawings, reference number 100 denotes a gangway. In accordance with prior art, gangway 100 (see FIGS. 1 and 2) includes a telescopic gangway section 1 which is extendable from and retractable into gangway 100. Gangway 100 and telescopic gangway section 1 are also provided with a telescopic railing 39. Gangway 100, in turn, is mounted in a support frame 25. Support frame 25 is mounted into a circular structure 2 and retained and freely movable in the circular structure 2 by means of several roller arrangements 3. Preferably, the circular structure 2 has two rocker shafts 4 mounted thereon which are supported on two bearing pedestals 5 mounted on two struts 6 mounted on a turning plate 7, which is movable so as to be able to accommodate rocking movement in the horizontal plane. The circular structure 2 includes rocker shafts 4 which are run through bearing pedestals 5, where rocker arms 8 are secured to rocker shafts 4, which rocker arms 8 are made movable by means, preferably, of hydraulic cylinders 9. Telescopic gangway section 1 is movable to a maximum length (see FIG. 5), and to a minimum length (see FIG. 6). FIG. 7 shows a section of the rear part of gangway 100 where telescopic gangway section 1 is made movable by means, preferably, of a hydraulic motor 10 positioned at the rear end of gangway 100 and, via driving gear 11, driving the rear telescopic shaft 12 which is supported at each side by beam structure 13, which is part of the structure of gangway 100. In order to move the telescopic gangway section 1 there is mounted on the rear telescopic shaft 12 at least one capstan 14, which drives wire 15 run to the front telescopic shaft 16 which, as shown in FIG. 5, is supported on beam structure 13 where at least one capstan 17 is mounted and where wire 15 is run around a capstan 17 on the front telescopic shaft and wire 15 is attached to the rear beam member structure 18 of the telescopic gangway section 1 by means of a wire mounting 18*a*. As shown in FIG. 7, mounted on the rear telescopic shaft 12 is a driving gear 19 for driving the rear balance weight shaft 20, which, preferably via two sprocket wheels 21 and chains 22 attached to the balance weight 23 by an attachment arrangement 22*a*, with the balance weight 23 running along a rail arrangement 24 mounted on beam structure 13. When the telescopic gangway section 1 is in the maximum extended position, as shown in FIG. 5, the gear ratio of drive gear 19 is configured so that the balance weight 23 is moved to the rear position in order to maintain balance at the balancing point provided by the rocker shafts 4. When the telescopic gangway section 1 is in the minimum extended position, as shown in FIG. 6, the gear ratio of driving gear 19 is configured so that the balance weight is moved to the front position in order to maintain balance at the balancing point provided by rocker shafts 4. To increase the strength, gangway 100 may be provided with support stays 26 extending from the top of support frame 25 to the front end of gangway 100, and with support stays 27 extending from the top of support frame 25 to the rear end of gangway 100. In order to add further stability to gangway 100, it may be provided with a gimbal (suspension) preferably consisting of an encased and preferably heavy gyro wheel 28 which has been made movable preferably by way of a hydraulic or electric motor (not shown) and rotates at a high rotational speed and is located in a horizontal position centrally mounted on the gangway near by the circular structure 2. As shown in FIG. 1, one or more possibly differently shaped suction cups 29 are located at the front end of the telescopic gangway section 1. Suction cups 29 may be attached to a mounting plate 30 which is movable relative to the telescopic gangway section 1 so that a change in the inclination of the telescopic gangway section 1 relative to the device to which it is connected will prevent the suction cups 29 from disengaging easily. At the front end of the telescopic gangway section 1, a buffer 31 of a softer material may be mounted in order to protect the structure to which gangway 100 is to be established as well as to dampen any impacts during connection. As shown in FIGS. 8 and 9, roll movement and changes in height, denoted as the Z direction, of the vessel on which gangway 100 is installed, will be accommodated by the rocker shafts 4 of gangway 100 so that gangway 100 may remain connected to the device to which gangway 100 is attached. A change in the distance between the vessel and the device to which the gangway 100 is attached, also denoted as the Y direction, is accommodated by a change in position of the telescopic gangway section 1. Pitch movements of the vessel on which gangway 100 is installed are accommodated by the circular structure 2 of gangway 100 so that gangway 100 remains relatively stable relative to the device to which gangway 100 is attached. A change in position between the vessel on which gangway 100 is installed and the device to which gangway 100 is attached, also denoted as the X direction, will be accommodated by turning plate 7. As shown in FIG. 3, the size of gangway 100 is adaptable to fit smaller vessels such as a pilot boat 32 in order to transfer personnel or equipment to other vessels. As shown in FIG. 4, gangway 100 may be used for transferring personnel and equipment in connection with maintenance of windmill installations, in which case a larger vessel 33 is provided with a larger version of gangway 100 that is connected to a receiving structure 34 of the windmill, the latter being a plane surface extending around the access platform 35 of windmill 38, thereby avoiding the need for using the more weather-exposed buffer structures 36 with associated ladders 37 to access the windmill.

When gangway 100 is connected to a device, an operator will bring telescopic gangway section 1 to a centre position between the maximum extended and minimum extended positions. The operator guides suction cups 29 towards a targeted connection point while the vessel on which gangway 100 is installed approaches the device to which a connection is desired. Vacuum is supplied to suction cups 29 and when contact has been established between the device and the suction cups 29, said cups sucks to the device and the operator brings the control handles to the neutral position and the hydraulic actuators 9 and motors of turning plate 7 are disengaged. The relative movements between the vessel on which gangway 100 is installed and the device to which transfer of personnel is desired are now accommodated by the telescopic section 1 of gangway 100, the gimbal suspension provided by the circular structure 2, and the rocker shafts 4, as well as turning plate 7.

The invention claimed is:

1. A gangway for transferring personnel and equipment from a first device to a second device which are able to move relative to each other, the gangway comprising:

gangway sections which are telescopically movable relative to each other, a first end section of the gangway being mounted on the first device, a second end section of said gangway being movable and mountable to said second device, wherein the first end section of the gangway, in a region thereof, is mounted in a support frame suspended within a gimbal suspension maintaining the gangway in a substantially horizontal plane, the gimbal suspension being located on a turning plate foundation mounted on said first device and the second end section of the gangway being provided with connector means for interconnection with said second device, the gimbal mounting being comprised of a circular structure having two external rocker shafts mounted thereon which are supported in respective bearing pedestals arranged on struts mounted on the turning plate foundation, and the support frame being provided externally with a number of roller arrangements retained and freely movable internally in the circular structure.

2. The gangway of claim 1, wherein the rocker shafts on the outside of the bearing pedestal are provided with rocker arms, whereby the support frame is rotatable.

3. The gangway of claim 2, wherein the rocker arms are connected by hydraulic cylinders (9).

4. The gangway of claim 1, wherein the gangway is provided with a first support stay extending from an upper region of the support frame to a front region of the gangway, and a second support stay extending from the upper region of the support frame to a rear region of the gangway.

5. The gangway of claim 1, wherein said connector means are suction cups mounted on the second end section of the gangway for being connected to an even surface of said second device.

6. The gangway of claim 5, wherein said suction cups are located on a mounting plate which is movable relative to the second end section of the gangway.

* * * * *